US007511696B2

(12) United States Patent
Cernasov et al.

(10) Patent No.: US 7,511,696 B2
(45) Date of Patent: Mar. 31, 2009

(54) DISPLAY WITH REDUCED POWER LIGHT SOURCE

(75) Inventors: Andrei Cernasov, Ringwood, NJ (US); Fernando R. De La Vega, Ridgefield Park, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/375,116

(22) Filed: Mar. 15, 2006

(65) Prior Publication Data

US 2007/0216311 A1 Sep. 20, 2007

(51) Int. Cl.
*G09G 3/36* (2006.01)

(52) U.S. Cl. ..... 345/102; 345/84; 345/103

(58) Field of Classification Search ..... 315/169.3, 315/291, 307, 308, 224, 312; 345/102, 82–84, 345/103

See application file for complete search history.

(56) References Cited

U.S. PATENT DOCUMENTS

2004/0113906 A1 6/2004 Lew et al.
2005/0073263 A1 * 4/2005 Havlik et al. ..... 315/169.3
2005/0073495 A1 4/2005 Harbers et al.
2005/0259439 A1 * 11/2005 Cull et al. ..... 362/612
2007/0115662 A1 * 5/2007 Roberts et al. ..... 362/252

OTHER PUBLICATIONS

H. De Lange Dzn, Relationship Between Critical Flicker-Frequency and a Set of Low-Frequency Characteristics of the Eye, Journal of the Optical Society of America, vol. 44, No. 5, pp. 380-389, May 1954.

* cited by examiner

*Primary Examiner*—Douglas W Owens
*Assistant Examiner*—Ephrem Alemu
(74) *Attorney, Agent, or Firm*—Ingrassia Fisher & Lorenz, P.C.

(57) ABSTRACT

A display includes a backlight comprising light sources. The light sources are divided into sections. The display also includes a transmissive display panel positioned adjacent to the backlight, a diffuser positioned between the backlight and the transmissive display panel, and a control circuit coupled to the backlight and the transmissive display panel. The control circuit synchronizes light output by the backlight with a transmittance of the transmissive display panel.

19 Claims, 9 Drawing Sheets

DISPLAY WITH REDUCED POWER LIGHT SOURCE

FIELD

Embodiments generally related to methods and systems of displaying video.

BACKGROUND

Most of today's high brightness liquid crystal display ("LCD") devices use fluorescent lamp backlights. Although less flexible than light emitting diode ("LED") backlights, the fluorescent lamp backlights have higher efficiency and, therefore, require less cooling than their LED backlight counterparts.

FIG. 1 illustrates a standard LCD 100 that utilizes LED backlighting. LCD 100 includes a LED backlight panel 102 composed of different colored LEDs 104. Typically, LEDs 104 are arranged in an alternating red, green, and blue pattern. LCD 100 also includes a diffuser 106 situated between backlight panel 102 and LCD panel 108.

LED backlight panel 102 creates a light source 110 with a relatively structured intensity, $I_{LED}$ (x,y). Diffuser 106 transforms light source 110 emitted from LED backlight panel into light source 112 with a substantially uniform intensity, $I_0$. Diffuser 106 allows both light and dark areas of a video to be equally illuminated on the backside of LCD panel 108. To create viewable video, LCD panel 108 changes the transmittance of each individual LCD pixel in LCD panel 108 based on an input signal to produce a video 114 with a varied intensity, $I_{LED}$ (x,y). Accordingly, the intensity of the video intensity $I_{LCD}$ (t,x,y) seen by a user of LCD 100 at a certain time corresponds to the desired video.

In LCD 100 that includes LED backlight panel 102, diffuser 106 and LCD panel 108, the desired video's intensity would be governed by the equation:

$$I_{LCD}(t, x, y)=I_0T_{0LCD}(t, x, y)$$

Where:

$I_{LCD}$(t,x,y) is the intensity of the video signal at a time t, $I_0$ is the uniform intensity from diffuser 106, and $T_{0LCD}$(t,x,y) is the transmittance of LCD panel 108 at time t.

In most video displayed on an LCD whether text, still images, or moving pictures, the different parts of the screen will have vastly different intensity levels depending on the video. Thus, in order to produce the different intensity levels, the LED backlight produces a high intensity light source to match the brightest portion of the video. Then, the intensity of the light source is reduced by changing the transmittance of the LCD panel for portions of the video that require a less intense illumination. Accordingly, the LED backlight must be supplied with high power constantly in order to produce the high intensity output to match the brightest portion of the video.

For example, if LCD 100 is displaying a video of a sunrise, LED backlight 102 would produce a uniform light source for the brightest portion of the video, i.e. the sun. Then, to create darker portions of the video, the transmittance of LCD panel 108 at locations other than the sun would be reduced. According to this method, the backlight must be powered at the intensity of the brightest portion of the video, even if the brightest portion makes up only a small amount of the entire video.

SUMMARY

Embodiments of the invention concern a display. The display includes a backlight comprising light sources. The light sources are divided into sections. The display also includes a transmissive display panel positioned adjacent to the backlight, a diffuser positioned between the backlight and the transmissive display panel, and a control circuit coupled to the backlight and the transmissive display panel. The control circuit synchronizes light output by the backlight with a transmittance of the transmissive display panel.

Additionally, embodiments of the invention concern a method of operating a display by synchronizing light emitted from a backlight and a transmittance of a transmissive display panel. The method includes dividing the backlight into sections of light sources. The method also includes determining an intensity of light emitted from each section of the light sources based on video to be displayed on the display and modifying the transmittance of the transmissive display panel to be synchronized with the intensity of each section of the light sources.

Further, embodiments of the invention concern another display. The display comprises means for determining an intensity of light emitted from sections of light sources of a backlight based on video to be displayed on the display and means for modifying a transmittance of a transmissive display panel to be synchronized with the intensity of each section of the backlight.

Additional embodiments of the invention will be set forth in part in the description which follows, and in part will be obvious from the description, or may be learned by practice of the invention. The embodiments of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention.

DETAILED DESCRIPTION

Embodiments of the present invention are related to devices and methods which lower the power consumption of a backlight by varying the intensity of light sources of the backlight based on an input video signal. To achieve this, the display does not uniformly set the brightness of the entire backlight to match brightest part of the picture. Instead, the display continuously adapts the intensity of individual light source tiles to the local characteristics of the video. Then, the transmittance of the display panel is synchronized with the modified intensity of the light source tiles. Power consumption of the backlight is reduced by not having to uniformly set the brightness of the entire backlight to the brightest part of the picture.

Particularly, the backlight is divided into a number of light source tiles. For example, the light source tiles may include one or more light sources in each tile. The display achieves the brightness of different parts of video by varying the intensity of the light generated by different light source tiles. As such, each light source tile produces a different intensity level corresponding to the video for that respective section of the display panel. The display then determines the transmittance of the corresponding area of the display panel based on the modified intensity of each light source tile.

Then, the display modifies the transmittance of the corresponding area of the display panel by synchronizing the modified backlight intensity with the modified transmittance of the display panel. For example, if the intensity of a particular tile of backlight is increased, the transmissivity of some of the pixels of the corresponding section of display panel may be decreased relative to the original video signal. Likewise, if the intensity of a particular tile of backlight is increased, the transmissivity of some of the pixels of the corresponding section of display panel may be increased relative to the original video signal.

Accordingly, power consumption of the backlight is reduced by not having to uniformly set the brightness of the entire backlight to match the brightest part of the picture.

In an embodiment, the light sources of the backlight may be light emitting diodes (LEDs).

Reference will now be made in detail to embodiments of the present invention, examples of which are illustrated in the accompanying drawings. Wherever possible, the same reference numbers will be used throughout the drawings to refer to the same or like parts.

Figure 1:
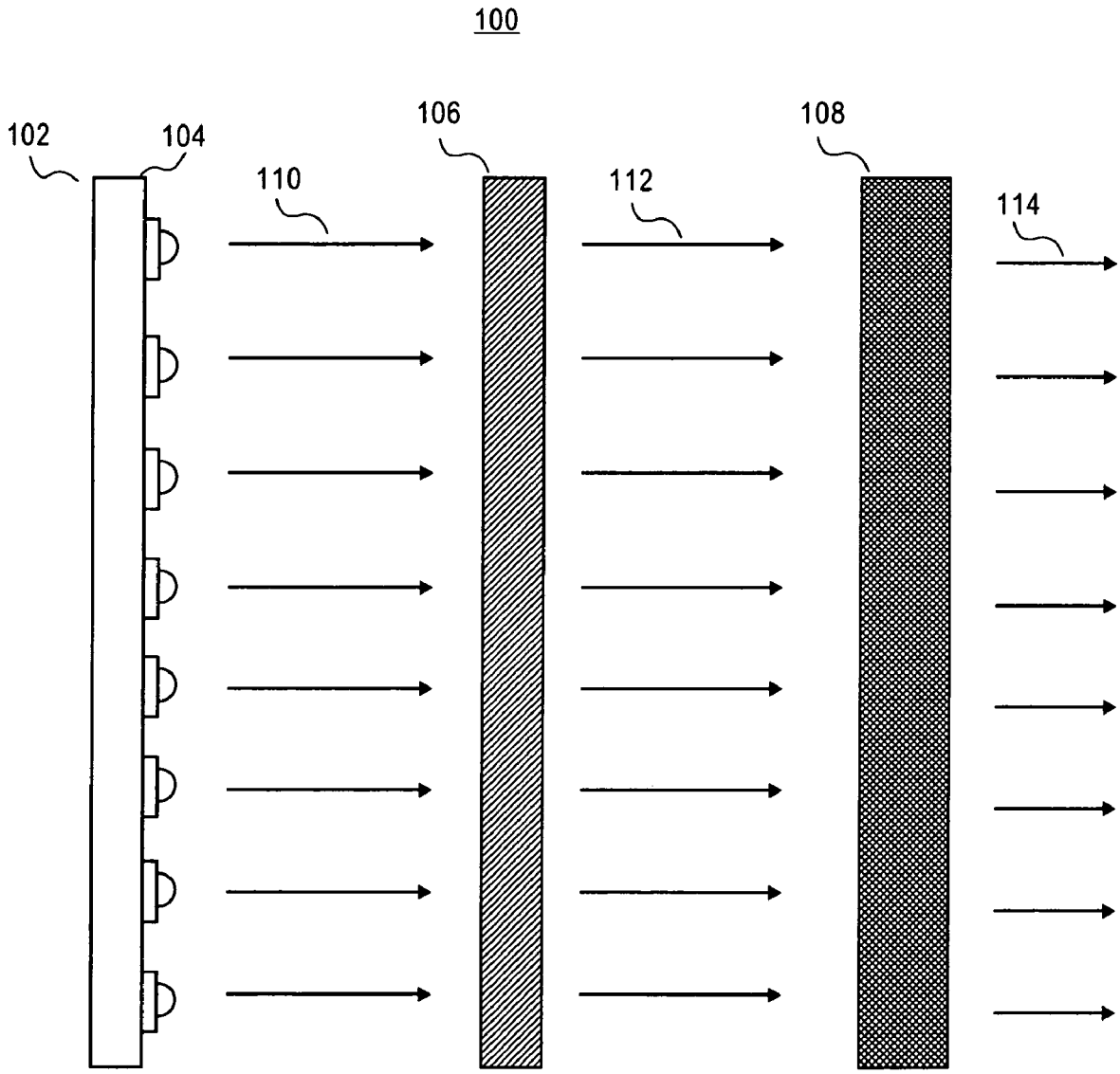
FIG. 1 is a diagram illustrating a conventional liquid crystal display.
Figure 2:
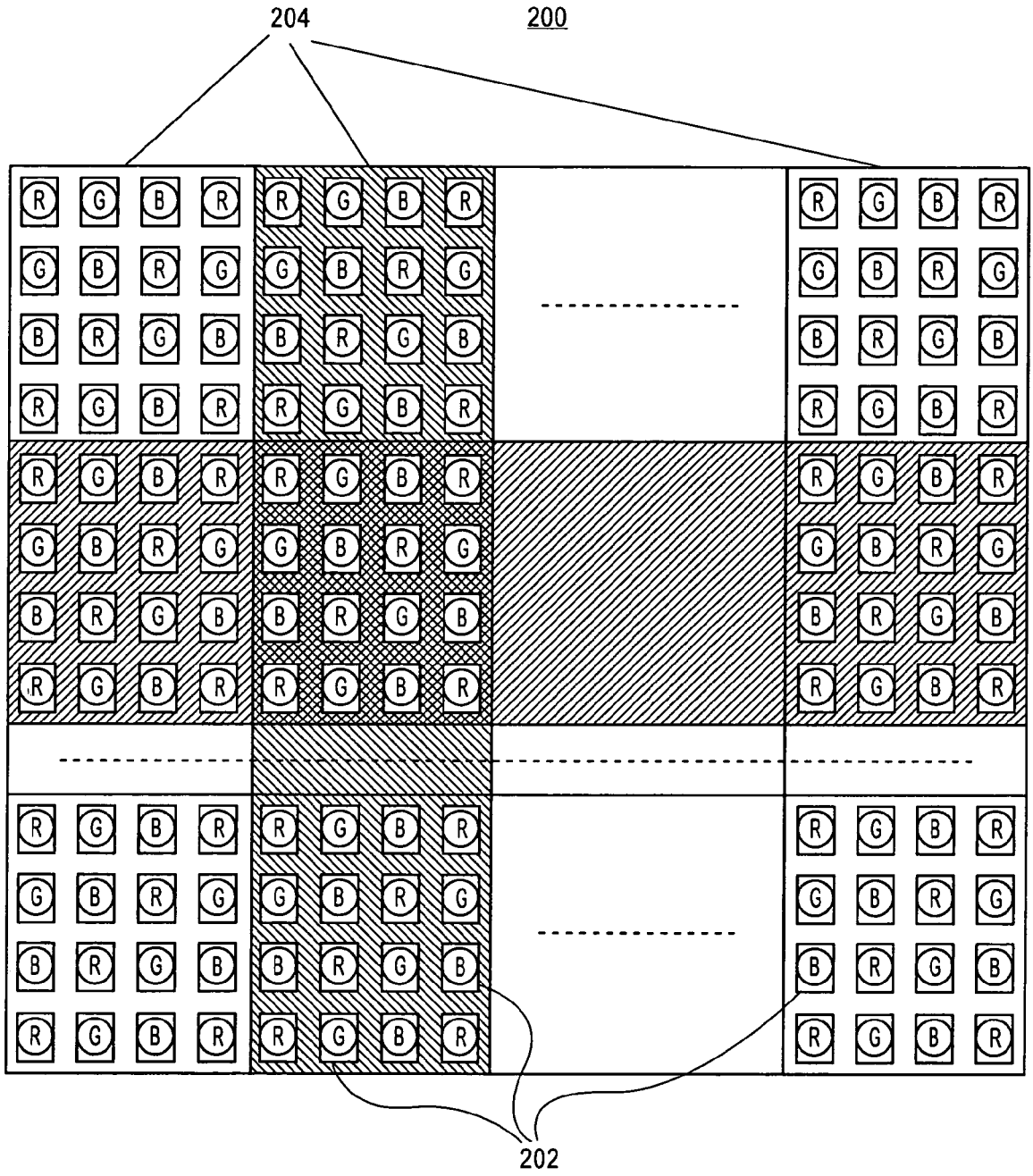
FIG. 2 is a diagram illustrating a backlight consistent with embodiments.

FIG. 2 illustrates a top view of an exemplary backlight panel 200 that is divided into tiles 204 consistent with embodiments. For example, backlight panel 200 is composed of individual light sources such as LEDs 202. One skilled in the art will realize LEDs 202 are exemplary and that backlight panel 200 may include any type of programmable light source.

The light sources may be any color such as white, red, green, or blue. As shown in FIG. 2, red, green, and blue LEDs 202 are placed in alternating order in both the x and y directions. One skilled in the art will realize that the color arrangement of LEDs 202 is merely an exemplary arrangement and different color LEDs 202 may be arranged in any order as required by the LCD.

The number of light sources contained in backlight panel 200 will vary based on the size of the LCD. For example, backlight panel 200 may be composed of a 20×8 LED array of LEDs 202. One skilled in the art will realize that the above number of LEDs 202 is merely an exemplary arrangement and different numbers of LEDs 202 may be included as required by the LCD.

As shown in FIG. 2, the light sources are grouped into LED tiles 204. For example, as illustrated in FIG. 2, backlight panel 200 may be divided such that tiles 204 contain 16 individual light sources such as LEDs 202. Embodiments of the present invention are not limited to the exemplary size of tiles 204 as shown in FIG. 2. One skilled in the art will realize that tiles 204 may contain any number of individual light sources such as LEDs 202. For example, tiles 204 may contain only one light source such as LED 202. Selection of the number of light sources contained in tiles 204 may be determined by the precision of control desired for the backlight intensity.

Figure 3:
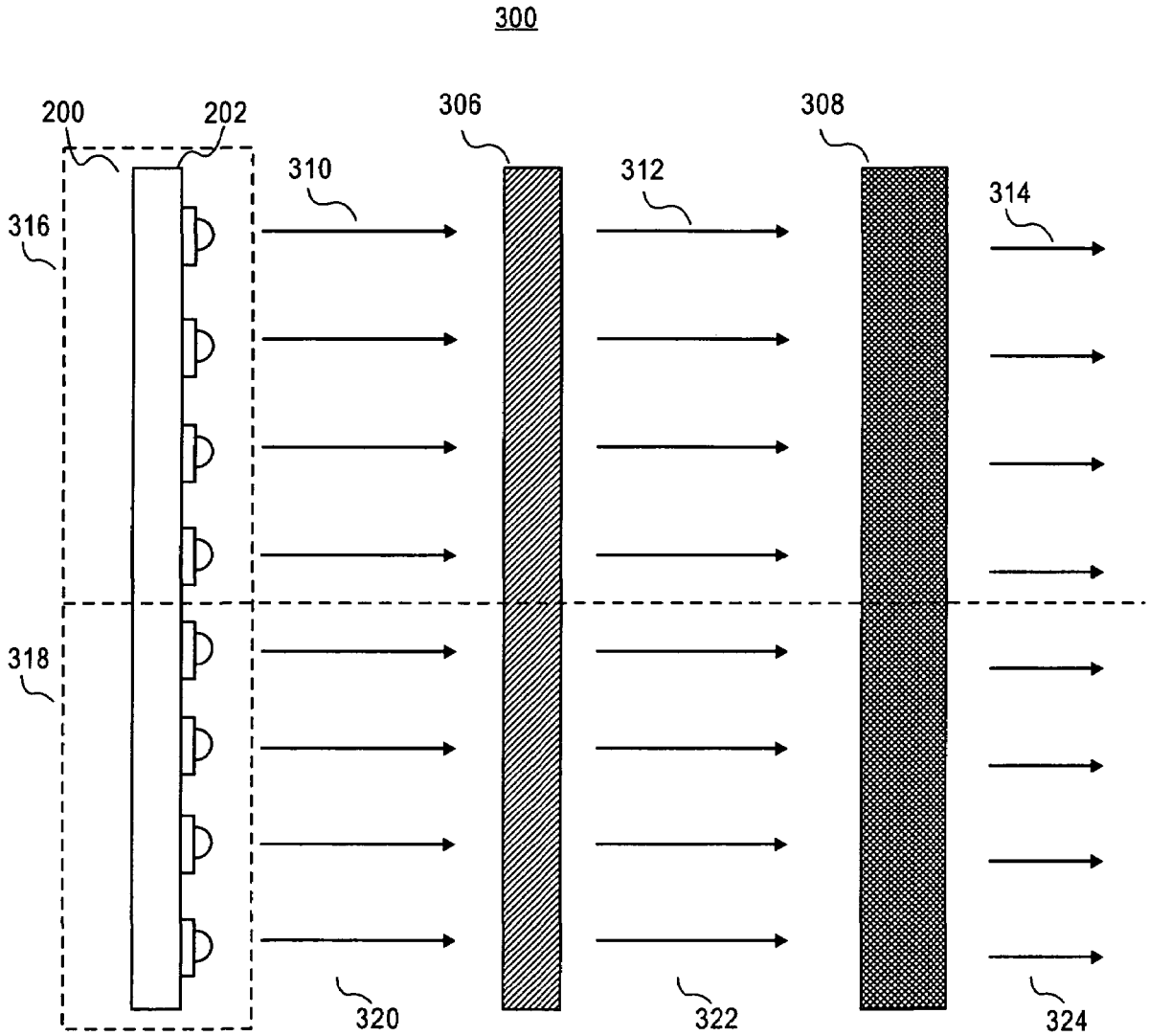
FIG. 3 is a diagram illustrating a display consistent with embodiments.

FIG. 3 illustrates a side view of an exemplary LCD 300 including backlight 200 as illustrated in FIG. 2 consistent with embodiments. LCD 300 contains a backlight panel 200 comprising a number of light sources such as LEDs 202. One skilled in the art will realize LEDs 202 are exemplary and that backlight panel 200 may include any type of programmable light source. LEDs 202 of backlight panel 200 are divided into N number of tiles 204 as illustrated in FIG. 2.

Two of tiles 204 are illustrated in FIG. 3, $\text{Tile}_N$ 316 and $\text{Tile}_{N+1}$ 318. For example, $\text{Tile}_N$ 316 and $\text{Tile}_{N+1}$ 318 may be divided as illustrated in FIG. 2 and contain 16 individual LEDs. One skilled in the art will realize that tiles 204, such as $\text{Tile}_N$ 316 and $\text{Tile}_{N+1}$ 318, may contain any number of individual LEDs 202. For example, $\text{Tile}_N$ and $\text{Tile}_{N+1}$ may contain only one LED 202.

According to embodiments, the brightness of different parts of video displayed on LCD 300 is achieved by varying the intensity of the light generated by different tiles 204. LCD 300 sets each tile to a different power level. As such, each tile produces a different intensity level corresponding to the video for the respective section of the LCD, for example video sections 314 and 324 as shown in FIG. 3.

As shown in FIG. 3, $\text{Tile}_N$ 316 generates a light source 310 with intensity $I_N$. $\text{Tile}_{N+1}$ 318 generates a different light source 320 with intensity, $I_{N+1}$. After passing through diffuser 306, the diffuser modifies light sources 310 and 320 to produce a light source 312 and 322, respectively, with a more uniform intensity.

To properly produce video, an approximate model for the light pattern generated by adjacent tiles may be determined. When two neighboring LED tiles, $\text{Tiles}_N$ 316 and $\text{Tile}_{N+1}$ 318, are driven at two different intensity levels, $I_N$ 310 and $I_{N+1}$ 320, the brightness in the transition area between the tiles needs to smoothly change from one level to the next. The following equations substantially approximate the intensity $I_{DIF}$ in the horizontal direction X for light sources 312 and 322 after diffuser 306 modifies the intensity:

$$I_{DIF}(x) = \frac{I_{N+1} - I_N}{2}\sin\left[\frac{\pi}{X_{N+1} - X_N}\left(X - \frac{X_{N+1} - X_N}{2}\right)\right] + \frac{I_{N+1} + I_N}{2}$$

or $$I_{DIF}(x) = \frac{I_{N+1} - I_N}{2}\sin\left[\frac{\pi}{\Delta X}(X - X_{Nmid})\right] + \frac{I_{N+1} + I_N}{2}$$

Where:

$$X_{Nmid} = \frac{X_{N+1} - X_N}{2}$$

$$\Delta X = X_{N+1} - X_N$$

Figure 4:
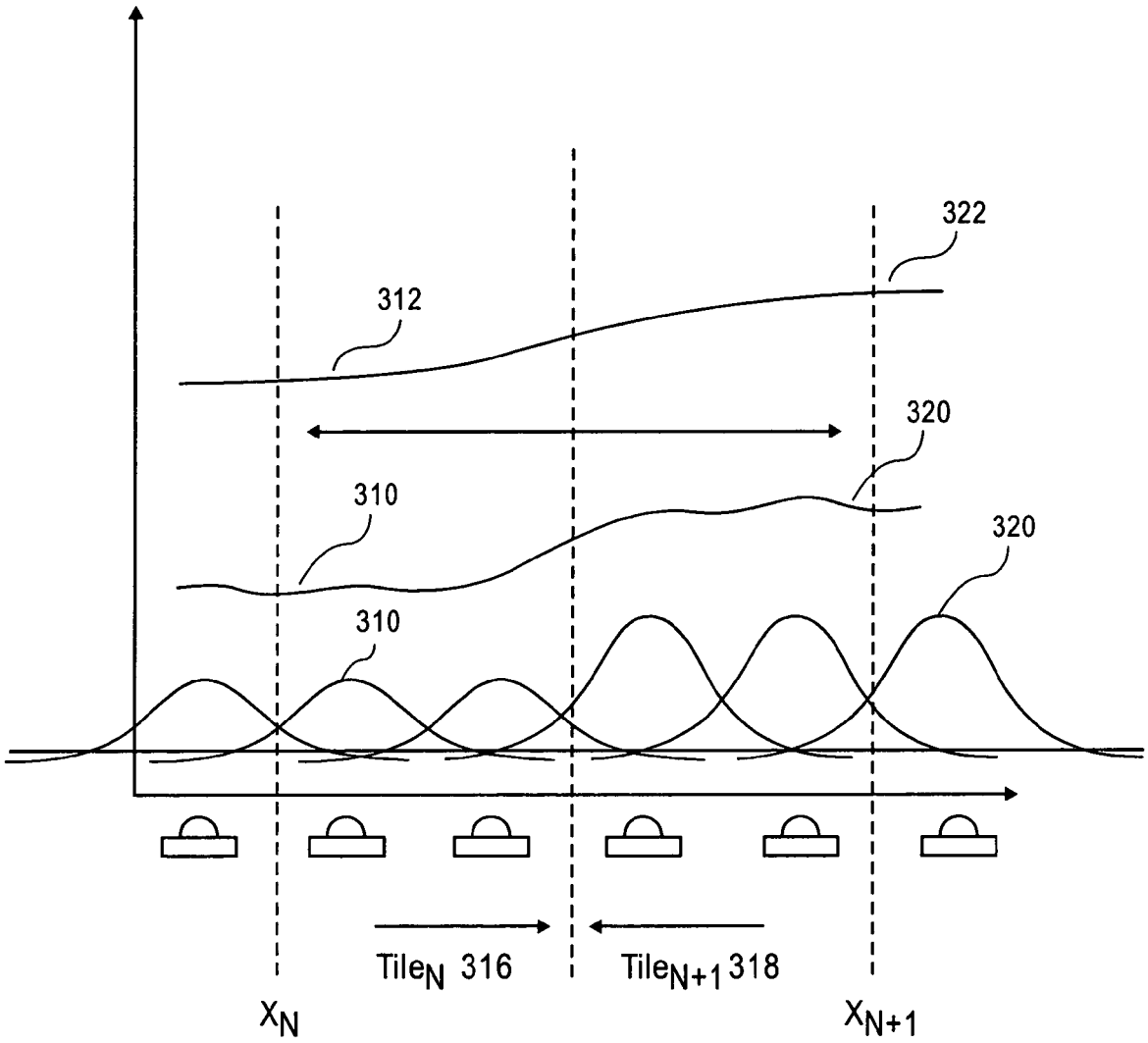
FIG. 4 is a graph illustrating display intensities consistent with embodiments.

FIG. 4 is a graph illustrating the light source intensities, $I_N$ and $I_{N+1}$ emitted by $\text{Tile}_N$ 316 and $\text{Tile}_{N+1}$ 318 substantially approximated by the equations above consistent with embodiments. As seen in FIG. 4, by applying the above equations, the transition in intensities $I_N$ and $I_{N+1}$ is smooth.

Figure 5:
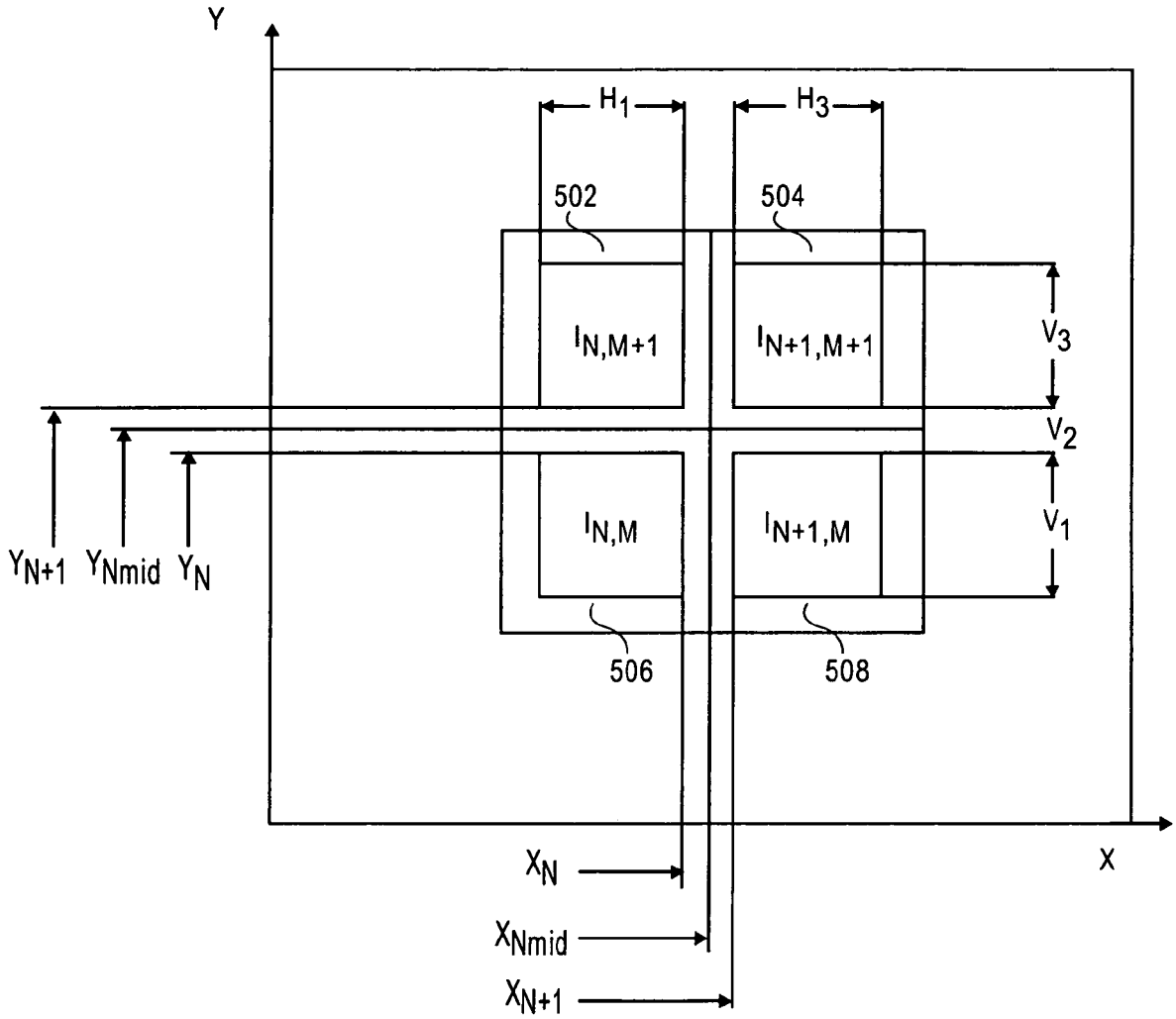
FIG. 5 is a diagram illustrating a backlight consistent with embodiments.

The above equations and FIG. 4 concern an LCD in which only the horizontal X direction was considered. FIG. 5 is a top view of a backlight panel illustrating four tiles 502, 504, 506, and 508 consistent with embodiments. For example, the backlight panel may be divided as illustrated in FIG. 2 in which the tiles contain 16 individual light sources such as LEDs. One skilled in the art will realize that any type of programmable light source may be divided as illustrated in FIG. 5. Additionally, one skilled in the art will realize that FIG. 5 illustrates only four exemplary tiles contained in backlight panel and backlight panel contains additional tiles not illustrated in FIG. 5. Further, one skilled in the art will realize that tiles 502, 504, 506, and 508 may contain any number of individual light sources.

To determine the intensity transitions between tiles in both the X and Y directions, a two dimensional sinusoidal matching function may be used. The following equations substantially approximate the intensity transitions for the four LED tiles illustrated in FIG. 5:

$$(x, y) \in H1 \cap V3 \Rightarrow I(x, y) = I_{N,M+1}$$

$$(x, y) \in H3 \cap V3 \Rightarrow I(x, y) = I_{N+1,M+1}$$

$$(x, y) \in H1 \cap V1 \Rightarrow I(x, y) = I_{N,M}$$

$$(x, y) \in H3 \cap V1 \Rightarrow I(x, y) = I_{N+1,M}$$

$$(x, y) \in H3 \cap V1 \Rightarrow I_{DIF}(x, y) = \frac{I_{N+1,M+1} - I_{N,M+1}}{2}\sin\left[\frac{\pi}{\Delta X}(X - X_{Nmid})\right] + \frac{I_{N+1,M+1} + I_{N,M+1}}{2}$$

$$(x, y) \in H2 \cap V1 \Rightarrow I_{DIF}(x, y) = \frac{I_{N+1,M} - I_{N,M}}{2}\sin\left[\frac{\pi}{\Delta X}(X - X_{Nmid})\right] + \frac{I_{N+1,M} + I_{N,M}}{2}$$

$$(x, y) \in H1 \cap V2 \Rightarrow I_{DIF}(x, y) = \frac{I_{N,M+1} - I_{N,M}}{2}\sin\left[\frac{\pi}{\Delta Y}(Y - Y_{Nmid})\right] + \frac{I_{N,M+1} + I_{N,M}}{2}$$

$$(x, y) \in H3 \cap V2 \Rightarrow I_{DIF}(x, y) = \frac{I_{N+1,M+1} - I_{N+1,M}}{2}\sin\left[\frac{\pi}{\Delta Y}(Y - Y_{Nmid})\right] + \frac{I_{N+1,M+1} + I_{N+1,M}}{2}$$

$$(x, y) \in H2 \cap V2 \Rightarrow I_{DIF}(x, y) = A\sin\left[\frac{\pi}{\Delta X}(X - X_{Nmid})\right]\left[\frac{\pi}{\Delta Y}(Y - Y_{Nmid})\right] + B\sin\left[\frac{\pi}{\Delta Y}(Y - Y_{Nmid})\right] + C\sin\left[\frac{\pi}{\Delta X}(X - X_{Nmid})\right] + D$$

Where:

$$A = \frac{I_{N,M} - I_{N+1,M} - I_{N,M+1} - I_{N+1,M+1}}{4}$$

$$B = \frac{-I_{N,M} - I_{N+1,M} - I_{N,M+1} + I_{N+1,M+1}}{4}$$

$$C = \frac{-I_{N,M} + I_{N+1,M} - I_{N,M+1} + I_{N+1,M+1}}{4}$$

$$D = \frac{I_{N,M} + I_{N+1,M} + I_{N,M+1} + I_{N+1,M+1}}{4}$$

$$X_{Nmid} = \frac{X_{N+1} + X_N}{2}$$

$$\Delta X = X_{N+1} - X_N$$

$$Y_{Nmid} = \frac{Y_{N+1} + Y_N}{2}$$

$$\Delta Y = Y_{N+1} - Y_N$$

Figure 6A:
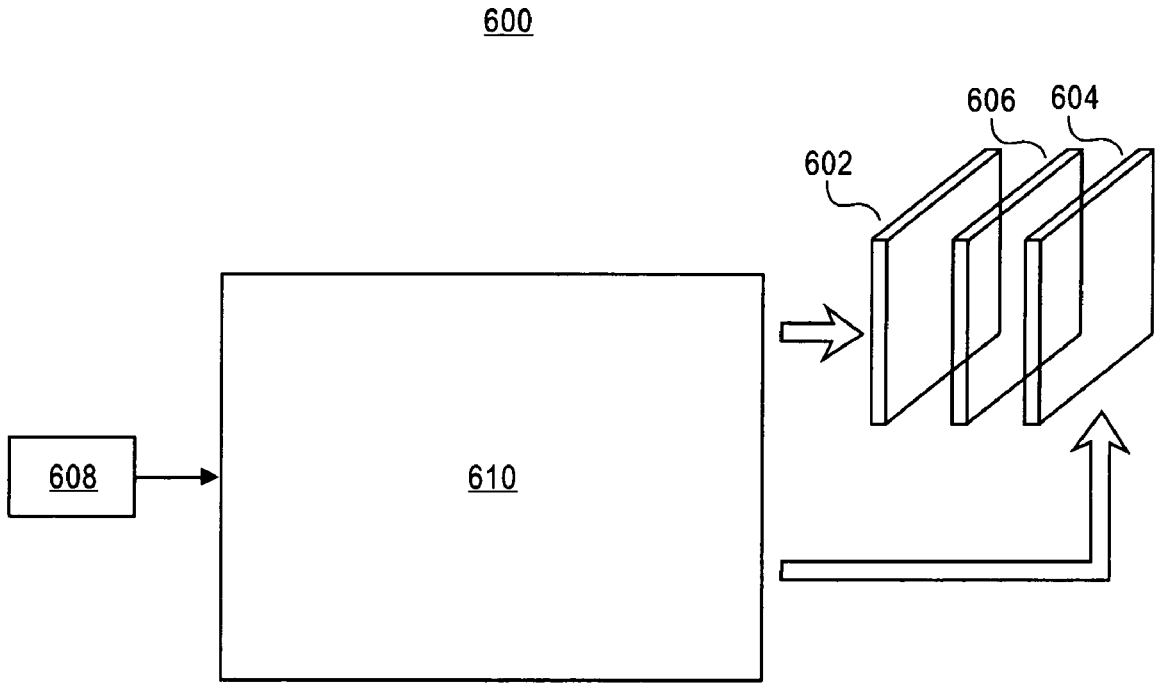
FIGS. 6A and 6B are block diagrams illustrating a display consistent with embodiments.
Figure 6B:
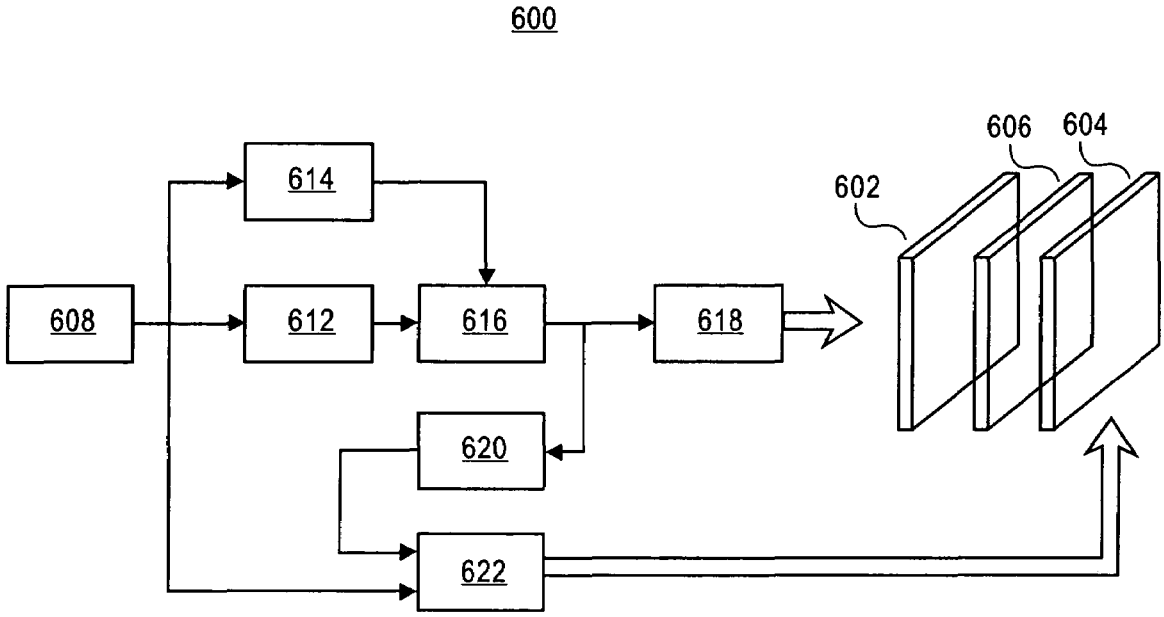

FIGS. 6A and 6B illustrated a display 600 consistent with embodiments. As shown in FIG. 6A, display 600 includes a backlight 602 and a display panel 604. Backlight 602 may be a backlight panel as illustrated in FIG. 2. Display panel 604 may be a transmissive display panel such as an LCD panel. Display 600 also includes a diffuser 606 disposed between backlight 602 and display panel 604. Display 600 also includes a frame buffer 608. Frame buffer 608 receives video from a video source and buffers the video before processing and display.

Display 600 also includes a control circuit 610 coupled to frame buffer 608 for modifying the intensity of backlight 602. Control circuit 610 modifies the backlight intensity by determining the intensity for different regions of the video. Regions of backlight 602 corresponding to the different regions of the video are then powered according to the determined intensity. Then, the transmissivity of display panel 604 synchronized with the modified backlight intensity.

Control circuit 610 may include any control and processing hardware, software, or combination thereof. For example, control circuit 610 may include a digital processor and memory coupled to the digital processor. In this example, the memory may contain the necessary logic to utilize the digital processor to control and power backlight 602 and display panel 604. Control circuit 610 may also contain the necessary logic to determine the intensity for regions of backlight 602. Control circuit 610 may also contain the necessary logic to synchronize the transmissivity of display panel 604 with the determined intensity for the regions of backlight 602.

FIG. 6B illustrates one example of the components of control circuit 610. Control circuit 610 comprises a two-dimensional low pass filter ("2D-LPF") 612 and a peak detector 614 coupled to frame buffer 608. 2D-LPF 612 receives video from frame buffer 608 and filters out the high spatial frequencies to produce a low resolution version of a frame of video. The low resolution version will be used to drive backlight 602.

Peak detector 614 also receives the video from frame buffer 608. Peak detector 614 determines if a small section of the video includes an extremely bright illumination. If a small section of the video includes an extremely bright illumination, peak detector 614 will produce a signal to set the section of backlight 602, which includes the small extremely bright section, to the highest brightness of backlight 602.

Control circuit 610 also includes a quantizer 616 coupled to 2D-LPF 612 and peak detector 614. Quantizer 616 selects the appropriate voltage level for different areas of backlight 602. Quantizer 616 may include a predetermined graduated voltage levels for the backlight. Quantizer 616 may select one of the predetermined voltage levels based on the low resolution image received from 2D-LPF 612 or the signal from peak detector 614.

Control circuit 610 also includes backlight drivers 618 coupled to quantizer 616. Backlight drivers 618 drives the different areas of backlight 602 based on the voltage levels received from quantizer 616. Control circuit 610 may include any number of backlight drivers 618 corresponding to the number of tiles in which backlight 602 is divided.

Control circuit 610 also includes a transmissivity determination section 620 coupled to quantizer 616. Transmissivity determination section 620 determines the amount by which the transmissivity of the areas of display panel 604 must be modified to match the modified backlight intensity. Transmissivity determination section 620 determines the amount based on the intensity levels determined by quantizer 616.

Transmissivity determination section 620 may include any control and processing hardware, software, or combination thereof to determine the amount by which the transmissivity must be modified. For example, transmissivity determination section 620 may include a digital signal processor, memory, or combinations of both.

Control circuit 610 also includes a transmissivity modification section 622 coupled to the transmissivity determination section 620. Transmissivity modification circuit synchronizes the transmissivity of display panel 604 with the modified intensity of backlight 602. Transmissivity modification section 622 modifies the transmissivity signal sent to display panel 604 based on the determination by transmissivity determination section 620.

Transmissivity modification section 622 may include any control and processing hardware, software, or combination thereof to determine the amount by which the transmissivity must be modified. For example, transmissivity modification section 622 may be a digital signal processor, memory, or combinations thereof.

Additionally, the operations performed by transmissivity modification section 622 and transmissivity determination section 620 may be performed by the same control and processing hardware, software, or combinations thereof. For example, transmissivity modification section 622 and transmissivity determination section 620 may be embodied in a digital signal processor, memory, or combinations thereof.

Figure 7:
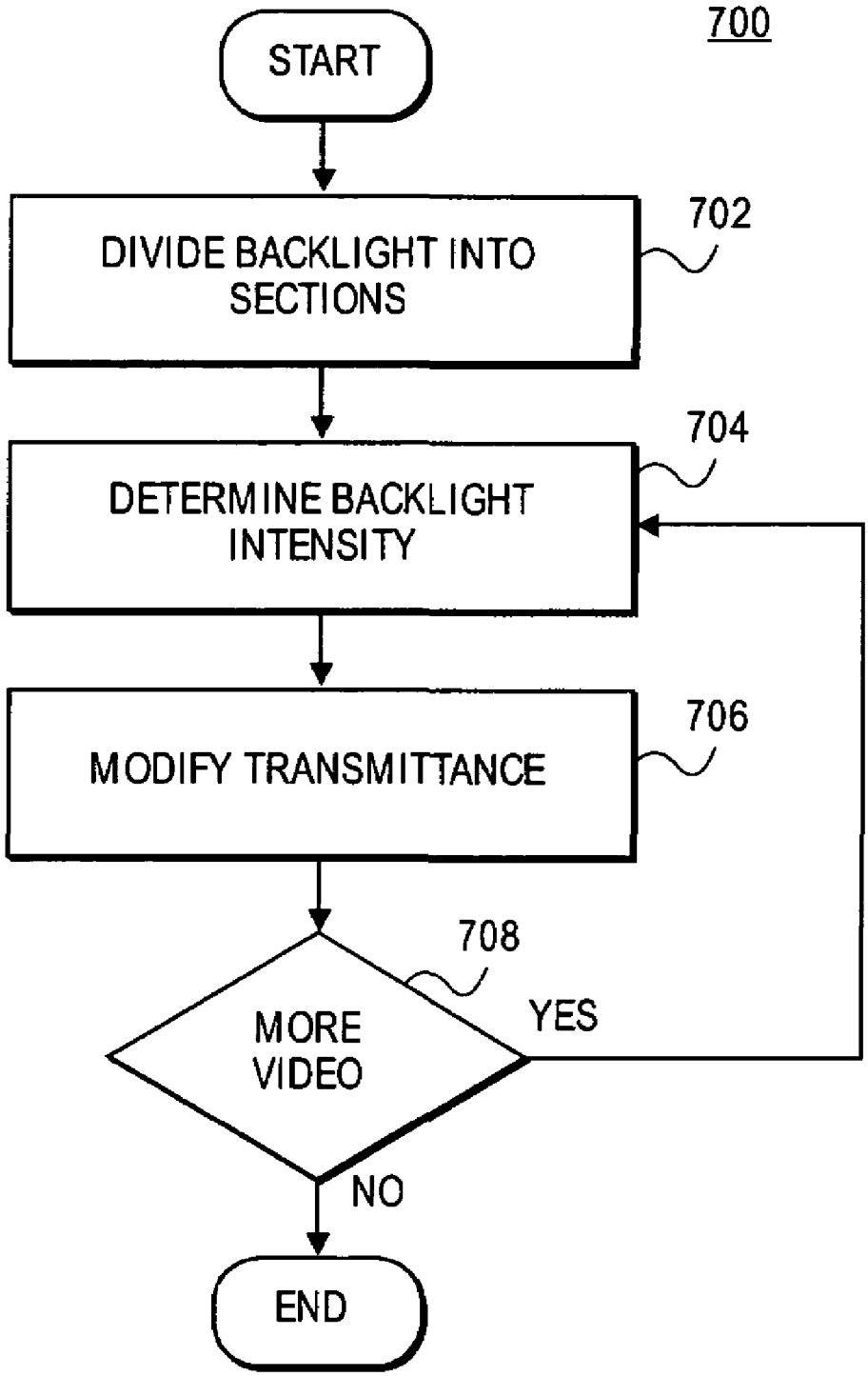
FIG. 7 is a flow chart illustrating a method consistent with embodiments.

FIG. 7 illustrates a method 700 for modifying the backlight intensity consistent with embodiments. In method 700, a backlight is separated into a number of individual tiles of light sources. The display controls the brightness of each individual tile in accordance with the local brightness of the video. The brightness of different parts of video displayed on display is achieved by varying the intensity of the light generated by different tiles. As such, each LED tile produces a different intensity level corresponding to different areas of the video. The transmittance of the different pixels of the display panel is set according to the brightness of each individual tile to produce the desired video output.

According to method 700, the backlight is divided into tiles (stage 702). The tiles may contain any number of individual light sources such as LEDs. One skilled in the art will realize that the tiles may include one or more light sources. For example, if system 600 is utilized, backlight 602 may be divided into tiles as illustrated in FIG. 2.

Next, an intensity of light emitted from the tiles is determined based on video to be displayed on the display (stage 704). If system 600 is utilized, control circuit 610 may determine the intensity of light emitted from the tiles. Control circuit 610 would receive video frames from frame buffer 608. Control circuit 610 would then determine the intensity of light emitted from the tiles based on the video received from frame buffer 608.

For example, control circuit 610 may determine the brightness of different areas of video received from frame buffer 608. Then, control circuit 610 may determine an intensity to match the brightness for the corresponding tile.

Then, a transmittance of the display panel is modified to be synchronized with the intensity of each tile of the backlight (stage 706). If system 600 is utilized, control circuit 610 may modify the transmissivity of the pixels of display panel 604. Control circuit 610 would take the determined intensity of each tile of backlight 602 and determine the amount that the corresponding section of display panel 604 must be modified.

For example, if the intensity of a particular tile of backlight 602 is increased, the transmissivity of some of the pixels of the corresponding section of display panel 604 may be reduced relative to the original video signal. Likewise, if the intensity of a particular tile of backlight 602 is increased, the transmissivity of some of the pixels of the corresponding section of display panel 604 may be increased relative to the original video signal.

Method 700 is repeated as long as video needs to be displayed (stage 708). Accordingly to method 700, power consumption of the backlight is reduced by not having the uniformly set the brightness of the entire backlight to the brightest part of the video.

Figure 8:
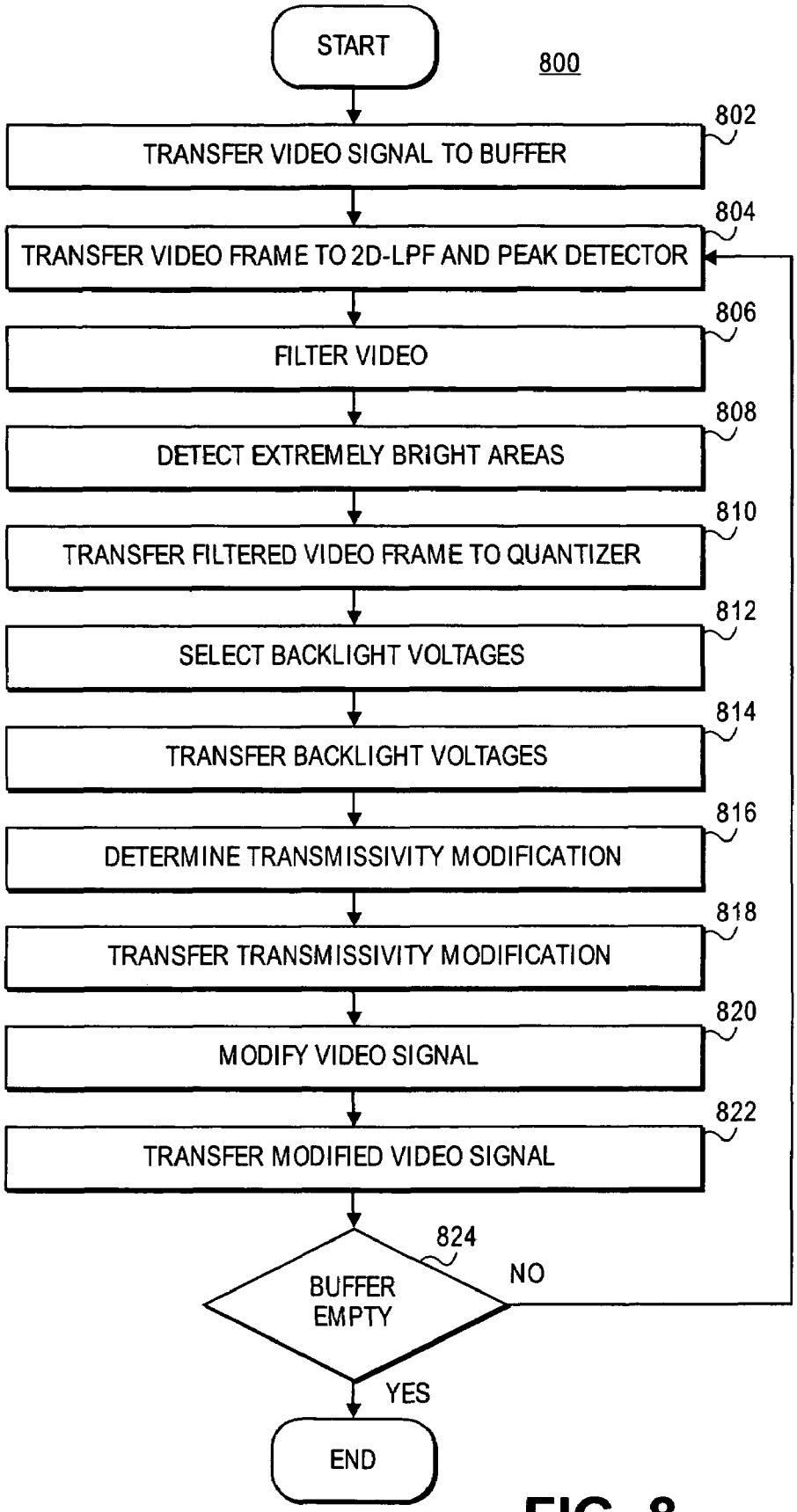
FIG. 8 is a flow chart illustrating a method of using a display consistent with embodiments.

FIG. 8 illustrates a method 800 for modifying the intensity of a backlight utilizing display 600 illustrated in FIG. 6B. First, display 600 transfers a video signal into frame buffer 608 (stage 802). Then, display 600 transfers the video frame by frame to 2D-LPF 612 and peak detector 614 (stage 804). 2D-LPF 612 receives video from frame buffer 608 and filters out the high spatial frequencies to produce a low resolution version of a frame of video that substantially matches the resolution of backlight 602 (stage 806). The low resolution version, along with the signal from peak detector 614, will be used to drive backlight 602.

Simultaneously with the filtering, peak detector 614 determines if any small section of the video includes an extremely bright illumination (stage 808). If a small section of the video includes an extremely bright illumination, peak detector 614 will produce a signal to set the corresponding section of backlight 602, which includes the extremely bright illumination, to the highest brightness of backlight 602.

Next, display 600 transfers the filtered video data to quantizer 616 (stage 810). Quantizer 616 selects the appropriate backlight voltage level based on the intensity needed for each area of the video and generates a voltage signal (stage 812). Quantizer 616 selects the appropriate voltage level for different areas of backlight 602 based on the output from either 2D-LPF 612 or peak detector 614.

Quantizer 616 may store predetermined graduated voltage levels for the backlight. Quantizer 616 may select one of the predetermined graduated voltage levels based on the low resolution image received from 2D-LPF 612 or the signal from peak detector 614.

Next, display 600 transfers the voltage signal to backlight driver 618 and to transmissivity determination section 620 (stage 814). Backlight drivers 618 drives the different areas of backlight 602 based on the voltage signal received from quantizer 616.

Based on the intensity levels determined by quantizer 616, transmissivity determination section 620 determines the modification to the transmissivity for corresponding section of display panel 604 (stage 816). Transmissivity determination section 620 may determine the transmissivity by first determining the $I_{DIF}$ for the frame. Transmissivity determination section 620 may determine $I_{DIF}$ using two dimensional approximation equations corresponding to FIG. 5. Then, transmissivity determination section 620 determines the ratio of a uniform intensity to the diffuser intensity:

$$\frac{I_0}{I_{DIF}(x, y)}$$

$I_0$ would be the intensity of backlight 602 after passing though diffuser 606 if backlight 602 was powered at a standard uniform intensity.

Next, display 600 transfers the modified transmissivity to transmissivity modification section 622 (stage 818). Transmissivity modification section 622 modifies the transmittance for the display panel to be synchronized with the backlight to produce a modified video signal for display panel 604 (stage 820). Transmissivity modification section 622 may determine the transmittance by multiplying the original video signal by the ratio from transmissivity determination section 620:

$$T_{LCD}(t, x, y) = \frac{I_0}{I_{DIF}(x, y)} T_{0LCD}(t, x, y)$$

Finally, display 600 transfers the modified video signal to the display panel and the video is displayed (stage 822). Method 800 is repeated until the video buffer is empty and thus, all the video signal has been displayed (stage 824). According to method 800, the backlight's power consumption is reduced by not having to uniformly set the brightness of the entire backlight to the brightest part of the picture.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A display, comprising:

a backlight divided into light source tiles, each light source tile configured in an array containing a plurality of light sources of differing colors;

a transmissive display panel positioned adjacent to the backlight;

a diffuser positioned between the backlight and the transmissive display panel; and a control circuit coupled to the backlight and the transmissive display panel, wherein the control circuit synchronizes light output by the backlight with a transmittance of the transmissive display panel, wherein the control circuit comprises:

an intensity determination section for determining an intensity of light emitted from each light source tile based on video to be displayed on the display, and a transmittance determination section for determining the transmittance of the transmissive display panel based on the intensity of light emitted from each light source tile.

2. The display of claim 1, wherein the control circuit synchronizes light output by the backlight with a transmittance of the transmissive display panel by synchronizing the light source tiles with corresponding sections of the transmissive display panel.

3. The display of claim 1, wherein the control circuit is configured to decrease the transmittance if the intensity is increased.

4. The display of claim 1, wherein the control circuit is configured to increase the transmittance if the intensity is decreased.

5. The display of claim 1, wherein the transmittance determination section comprises:

logic for determining a first intensity of light emitted from each light source tile based on video to be displayed on the display;

logic for determining a second intensity of the light emitted from each light source tile after passing through the diffuser; and logic for determining the transmittance of the transmissive display panel based on the second intensity.

6. The display of claim 5, wherein the control circuit further comprises:

a transmittance modification section for synchronizing light output by the backlight with the transmittance of the transmissive display panel based on the determined transmittance.

7. The display of claim 6, wherein the transmittance determination section further comprises:

logic for determining a ratio of a uniform intensity and the second intensity, wherein the transmittance of the transmissive display panel is modified by the ratio of the uniform intensity and the second intensity.

8. A method of operating a display by synchronizing light emitted from a backlight having a plurality of light sources and a transmittance of a transmissive display panel, comprising:

dividing the backlight into light source tiles, each light source tile configured in an array containing a plurality of light sources of differing colors;

determining an intensity of light emitted from each light source tile based on video to be displayed on the display; and modifying the transmittance of the transmissive display panel to be synchronized with the intensity of each light source tile, wherein modifying the transmittance of the transmissive display, comprises:

synchronizing light output by the backlight with the transmittance of the transmissive display panel by synchronizing the light source tiles with corresponding sections of the transmissive display panel, and determining the transmittance of the transmissive display panel based on the intensity of light emitted from each light source tile.

9. The method of claim 8, further comprising decreasing the transmittance as the intensity increases.

10. The display of claim 8, further comprising increasing the transmittance as the intensity decreases.

11. The method of claim 8; wherein determining the transmittance of the transmissive display panel, comprises:

determining a first intensity of light emitted from each light source tile based on the video to be displayed on the display;

determining a second intensity of the light emitted from each light source tile after passing through a diffuser; and determining the transmittance of the transmissive display panel based on the second intensity.

12. The method of claim 11, wherein determining the transmittance of the transmissive display panel, comprises:

determining a ratio of a uniform intensity and the second intensity.

13. The method of claim 12, wherein modifying the transmittance of the transmissive display panel, comprises:

modifying the transmittance of the transmissive display panel based on the video and the ratio of the uniform intensity and the second intensity.

14. A display, comprising:

a backlight that includes light sources, an area of the backlight divided into light source tiles such that each light source tile is configured in an array containing a plurality of light sources of differing colors;

means for determining an intensity of light emitted from each light source tile of the backlight based on video to be displayed on the display; and means for modifying a transmittance of a transmissive display panel to be synchronized with the intensity of light from each light source tile of the backlight.

15. The display of claim 14, further comprising:

means for synchronizing light output by the backlight with a transmittance of the transmissive display panel by synchronizing the light source tiles with corresponding sections of the transmissive display panel.

16. The display of claim 14, further comprising:

means for determining the transmittance of the transmissive display panel based on the intensity of light emitted from each light source tile.

17. The display of claim 16, further comprising:

means for determining a first intensity of light emitted from each light source tile based on video to be displayed on the display;

means for determining a second intensity of the light emitted from each light source tile after passing through a diffuser; and means for determining the transmittance of the transmissive display panel based on the second intensity and the video.

18. The display of claim 17, further comprising:

means for synchronizing light output by the backlight with the transmittance of the transmissive display panel based on the determined transmittance.

19. The display of claim 17, wherein the transmittance determination section further comprises:

means for determining a ratio of a uniform intensity and the second intensity, wherein the transmittance of the transmissive display panel is modified based on the video and the ratio of the uniform intensity and the second intensity.

* * * * *